US005706958A

United States Patent [19]

Spamer

[11] Patent Number: 5,706,958

[45] Date of Patent: Jan. 13, 1998

[54] GRAVITY FEED BOTTLE DISPENSING DEVICE HAVING TRACK-BLOCKING RATCHET WHEEL

[75] Inventor: William S. Spamer, Roswell, Ga.

[73] Assignee: The Mead Corporation, Dayton, Ohio

[21] Appl. No.: 635,847

[22] Filed: Apr. 22, 1996

[51] Int. Cl.[6] ..... A47F 1/04

[52] U.S. Cl. ..... 211/59.2; 211/74; 221/289

[58] Field of Search ..... 211/59.2, 74, 83, 211/162; 221/289, 298, 124

[56] References Cited

U.S. PATENT DOCUMENTS

| | | | |
|---|---|---|---|
| 769,063 | 8/1904 | Dawson et al. | 221/289 |
| 1,958,781 | 5/1934 | Beukema | 211/74 X |
| 2,279,093 | 4/1942 | Peters | 221/15 |
| 2,327,379 | 8/1943 | Thomas | 211/74 |
| 2,332,214 | 10/1943 | Forstheofel et al. | 221/433 |
| 2,440,902 | 5/1948 | Lutey | 294/87.28 |
| 2,620,691 | 12/1952 | Gould | 211/74 X |
| 2,869,903 | 1/1959 | Hewitt | 211/162 |
| 3,158,289 | 11/1964 | Van Brunt | 221/289 X |
| 3,243,220 | 3/1966 | Karas | 294/87.28 |
| 3,553,927 | 1/1971 | Anglada, Jr. | 53/448 |
| 4,022,363 | 5/1977 | Eliassen | 294/87.2 |
| 4,072,246 | 2/1978 | Paulin | 221/307 |
| 4,206,941 | 6/1980 | Wild | 294/87.26 |
| 4,228,905 | 10/1980 | Cammarota | 211/71 |
| 4,310,097 | 1/1982 | Merl | 211/59.2 |
| 4,318,484 | 3/1982 | Clement | 211/74 X |
| 4,318,485 | 3/1982 | Clement | 211/59.2 |
| 4,367,818 | 1/1983 | Suttles | 211/74 X |
| 4,401,221 | 8/1983 | Suttles | 211/59.2 |
| 4,456,147 | 6/1984 | Tominaga | 211/59.2 X |
| 4,909,401 | 3/1990 | McConnell | 211/74 |
| 4,917,264 | 4/1990 | Gasiel et al. | 221/289 X |
| 5,018,681 | 5/1991 | Weimer et al. | 211/162 X |
| 5,209,358 | 5/1993 | Simard | 211/74 |
| 5,224,659 | 7/1993 | Gabardi | 221/298 X |

FOREIGN PATENT DOCUMENTS

| | | | |
|---|---|---|---|
| 72.00294 | 8/1973 | France | 211/49 |

*Primary Examiner*—Leslie A. Braun
*Assistant Examiner*—Anita M. King
*Attorney, Agent, or Firm*—Tsugihiko Suzuki

[57] ABSTRACT

A bottle dispenser has a gate mechanism to maintain the foremost one of the track-supported bottles substantially vertical. The dispenser includes an elongate track defining a longitudinally extending pathway, a support structure, and a stopper provided at the front end of the track. The track supports a row of flanged bottles such that the bottles are suspended by their neck flanges for movement along the pathway and removable from the pathway through the front end of the track. The support structure supports the track such that the track is inclined toward its front end whereby the suspended bottles are allowed to gravity feed toward the front end when the leading bottle in the row is removed from the track. The stopper engages with the leading bottle to prevent its accidental removal through the front end. The gate mechanism comprises a rotary rachet wheel disposed at least partially in the track for engagement with the bottles and a movable catch arm arranged to take a catching position for restricting rotation of the ratchet wheel in response to arrival of the leading bottle at the front end of the track.

10 Claims, 5 Drawing Sheets

GRAVITY FEED BOTTLE DISPENSING DEVICE HAVING TRACK-BLOCKING RATCHET WHEEL

BACKGROUND OF THE INVENTION

This invention relates to forward feed merchandising devices for soft drink bottles, and particularly to a gravity feed bottle dispensing device in which soft drink bottles are suspended by their neck flanges and carried forward by gravity on an inclined track.

Gravity feed bottle dispensers of the suspension type have been used in the merchandising of soft drink bottles such as PET bottles having outwardly projecting annular neck flanges. These dispensers have an elongate track having a pair of parallel rails extending along the track. The necks of flanged bottles are received between the track rails so that the bottles are engaged at their neck flanges with the rails and thus suspended by their necks. The bottles are automatically arranged in a row along the track as they are received in the track. The track is normally inclined downwardly toward its front end and thus the suspended bottles are allowed to gravity feed one after another to the front end as the leading or foremost bottles in the row are removed successively from the track through the front end. A length of the track adjacent to the front end is upturned relative to the remainder of the track to stop each leading bottle at the front end and to thereby present it for removal from the track. Conventional gravity feed bottle dispensers of the type described above are disclosed, for example, in U.S. Pat. Nos. 4,318,485; 4,367,818; and 4,401,221 which are owned by the assignee of the present invention.

While such conventional dispensers have experienced considerable success, they are not without disadvantages. When stopped at the front end, the leading bottle on the track is subject to pressure of the other bottles behind it and is thereby pushed forward. This causes the leading bottle to be tilted with respect to the vertical while it is presented for removal by customers. This can detract from the appearance of the displayed bottles particularly when two or more tracks are arranged side by side and the respective leading bottles on adjacent tracks are tilted at different angles.

What is needed, therefore, is an improved gravity feed bottle dispensing device which maintains the leading bottles substantially vertical.

SUMMARY OF THE INVENTION

In meeting the foregoing needs, the present invention provides a merchandising device for neck-flanged bottles. The device includes an elongate track which defines a longitudinally extending pathway, a support structure for the track, and a stopper provided at the front end of the track. The track supports a row of flanged bottles such that the bottles are suspended by their neck flanges for movement along the pathway and are removable from the pathway through the front end of the track. The support structure supports the track in a tilted condition such that the track is inclined downwardly toward its front end whereby the suspended bottles are allowed to gravity feed toward the front end when the leading bottle in the row is removed from the track. The stopper engages with the leading bottle to prevent its accidental removal through the front end. To improve the above basic arrangements, the device of the invention comprises a gate mechanism for blocking the pathway at a position between the front and rear ends of the track. The gate mechanism comprises a rotary rachet wheel disposed at least partially in the track for engagement with the bottles and a movable catch arm arranged to take a catching position for preventing rotation of the ratchet wheel in response to arrival of the leading bottle at the front end of the track. When the leading bottle arrives at the front end, the catch arm interfere with rotation of the rachet wheel which, in turn, blocks the pathway so that forward movement of the other bottles behind the leading bottle is blocked. This allows the leading bottle to be free of pressure of the other bottles and to be disposed substantially vertical when stopped at the front end of the track.

According to a preferred embodiment of the invention, the catch arm is arranged to take a releasing position to allow rotation of the ratchet wheel in response to removal of the leading bottle from the front end of the track. The catch arm may be pivotally connected to the track for movement between the catching and releasing positions. In this embodiment, the catch arm may have a forward end adjacent the front end of the track and extend generally along the pathway to the backward end. The catch arm may be pivotally connected at an intermediate position thereof to the track. The ratchet wheel may be located behind and adjacent to the catch arm to engage the backward end of the catch arm when catch arm is in the catching position. The forward end of the catch arm may be disposed within the bottle pathway when the arm is in the releasing position. By this means, the forward end is thrust aside by the leading bottle to take the catching position upon arrival of the leading bottle at the front end.

According to a preferred embodiment of the invention, the catch arm is arranged to prevent the ratchet wheel from rotating only in a single direction. The ratchet wheel may be connected to the track for rotation about a substantially horizontal axis generally perpendicular to the track. The ratchet wheel may have a plurality of teeth extending radially outwardly of its rotational axis. The teeth may be spaced so that an upper end of a bottle is received between adjacent teeth.

The objects and advantages of the present invention will be apparent from the following description, the accompanying drawings and the appended claims.

DETAILED DESCRIPTION OF THE PREFERRED EMBODIMENT

FIGS. 1 to 5 illustrate a merchandising device according to this invention. The device includes one or more bottle dispenser units of the kind shown in FIG. 1 removably mounted on a rack. The rack may be a conventional four-post rack as partially shown in FIG. 1. Alternatively, the rack may be composed of a base having a vertically extending back wall on which unit-supporting arms are cantilevered. The device may have only one dispenser unit; however, it will in general have two or more dispenser units arranged one above another.

Figure 1:
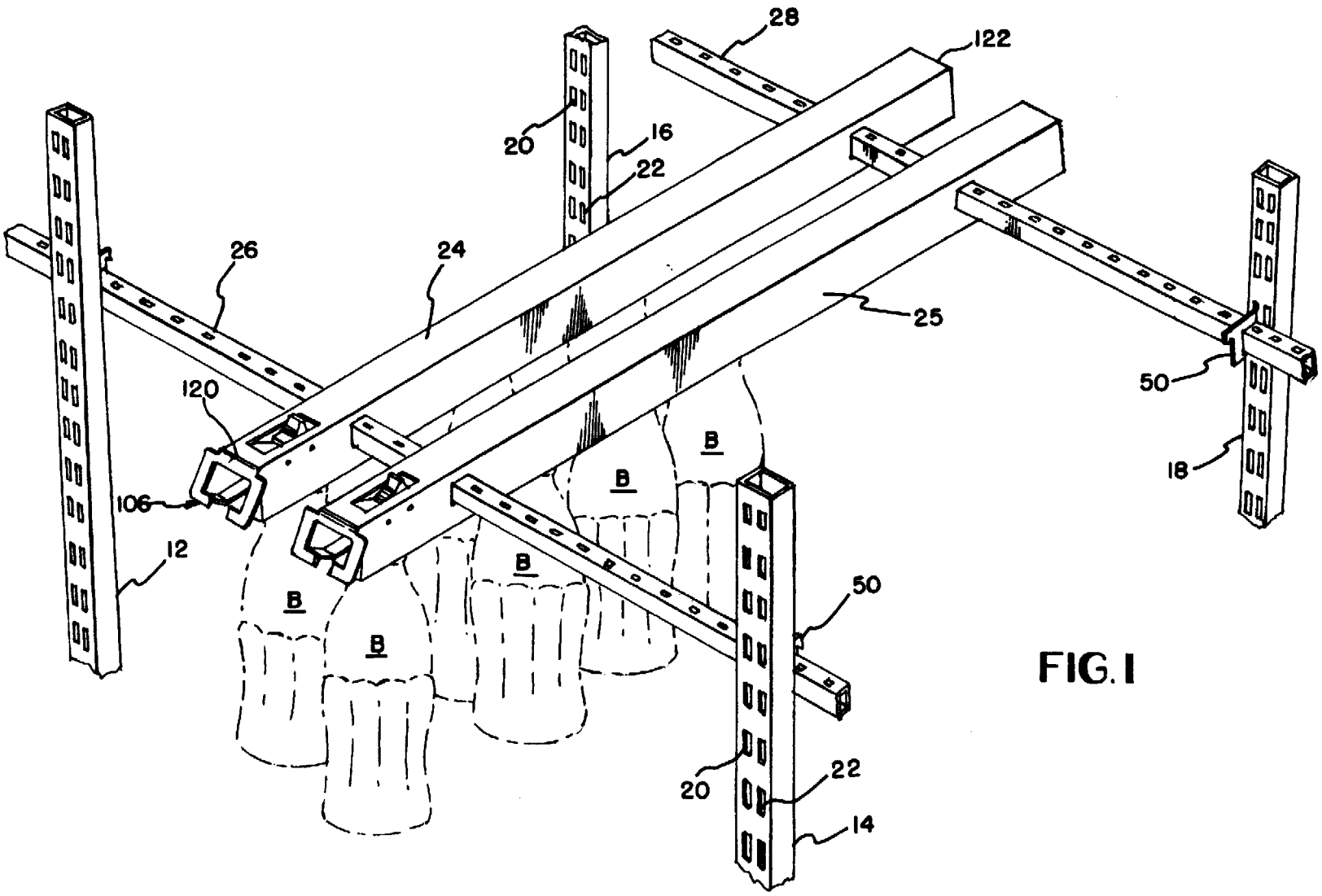
FIG. 1 is a perspective view of a dispenser unit of a merchandising device according to the present invention.

The dispenser unit in FIG. 1 is designed for use preferably on a four-post rack having four upright corner posts, i.e., a pair of front posts 12 and 14 and a pair of rear posts 16 and 18, connected together by horizontal members of a suitable number. The four corner posts 12, 14, 16 and 18 are of a substantially identical structure having a number of engaging openings arranged vertically along the side wall of the respective corner post. In FIG. 1, each post is shown as having two vertical rows of openings 20 and 22. However, one vertical row of openings in each corner post may be sufficient in most of the cases wherein the post is used as a vertical support for the dispenser units.

The dispenser unit in FIG. 1 has a plurality of substantially parallel elongate tracks 24 and 25 interconnected through a pair of front and rear transverse support members 26 and 28. The tracks 24 and 25 are virtually identical to each other, and so are the front and rear transverse members 26 and 28. Accordingly, the details will hereinafter be described regarding only the track 24 and the transverse member 26. Those portions of the track 25 identical to the track 24 are identified by the same reference numerals, and those of the member 28 identical to the member 26 are denoted by the same reference numerals.

Figure 2:
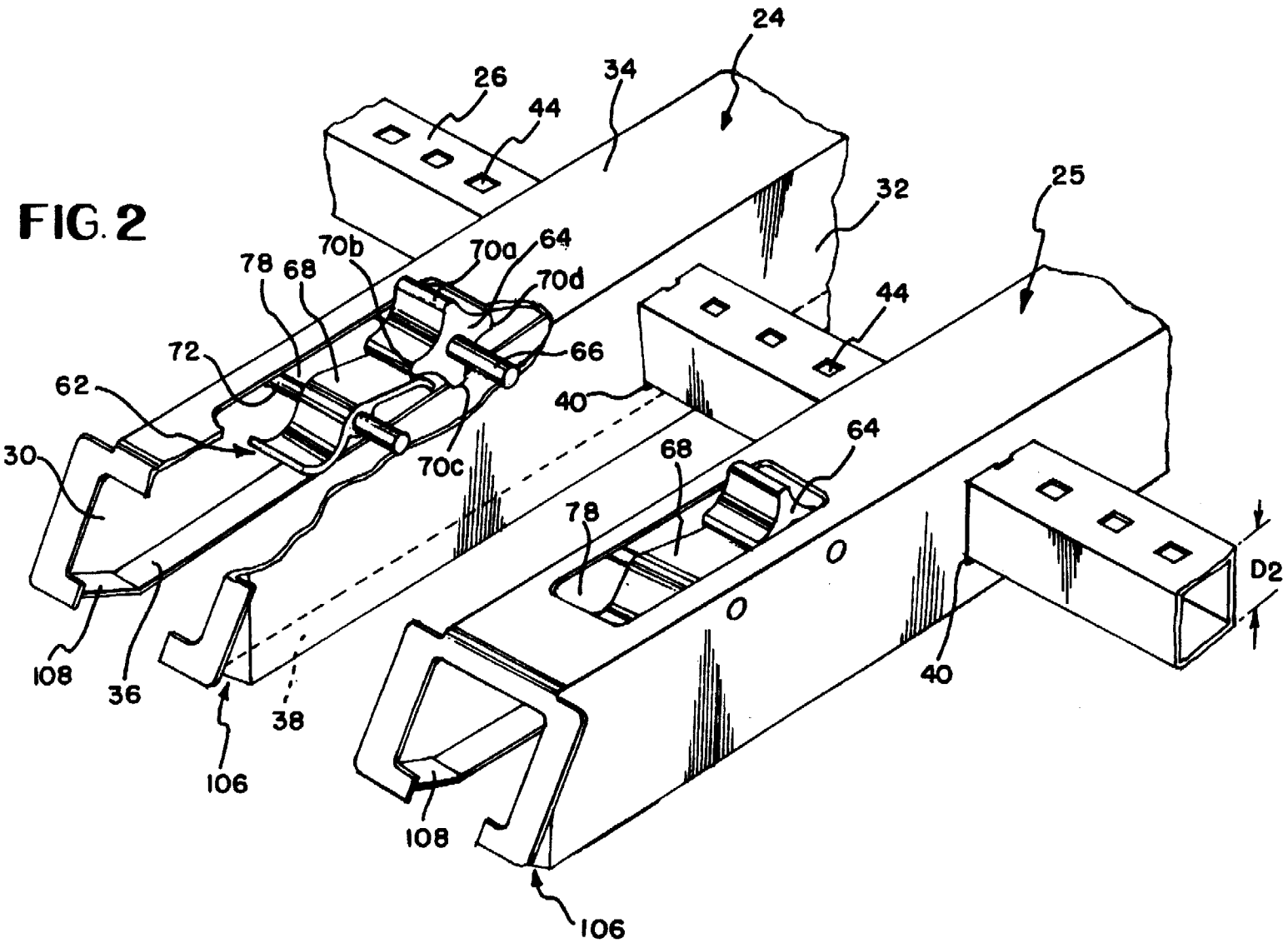
FIG. 2 is an enlarged fragmentary perspective view, partially cutaway, of the tracks in FIG. 1.

Referring to FIG. 2, the track 24 is formed preferably of a metal plate or a molded plastic and has a pair of longitudinally extending opposed side walls 30 and 32 joined together along their upper edges by a top wall 34. The side walls 30 and 32 and the top wall 34 in cooperation form a channel structure having an inverted U-shaped cross section. A pair of parallel rails 36 and 38 are joined respectively along the lower edges of the side walls 30 and 32 so as to project inwardly of the track 24 toward each other. A space is maintained between the rails 36 and 38 to receive therein the necks of flanged bottles. The distance between the rails 36 and 38 are such that when bottle necks are received between the rails 36 and 38, the bottles are automatically arranged in a row and the undersides of the neck flanges engage the rails 36 and 38 to allow the bottles to be suspended for sliding movement along the track 24.

Typical flanged bottles used with the device of the invention may be soft drink bottles formed of plastic such as PET and having integrally formed outwardly projecting annular flanges at their necks immediately under their caps. Bottles suspended by their neck flanges are shown in FIGS. 1 and 3–5 wherein the bottles are designated at "B" and the bottle neck flanges are designated at "F". The bottles suspended and arranged in a row gravity feed one after another to the front end (show in FIG. 1) of the track 24 as the leading bottles in the row successively are removed from the track 24 through the front end 120, which will be described in more details later.

Figure 3:
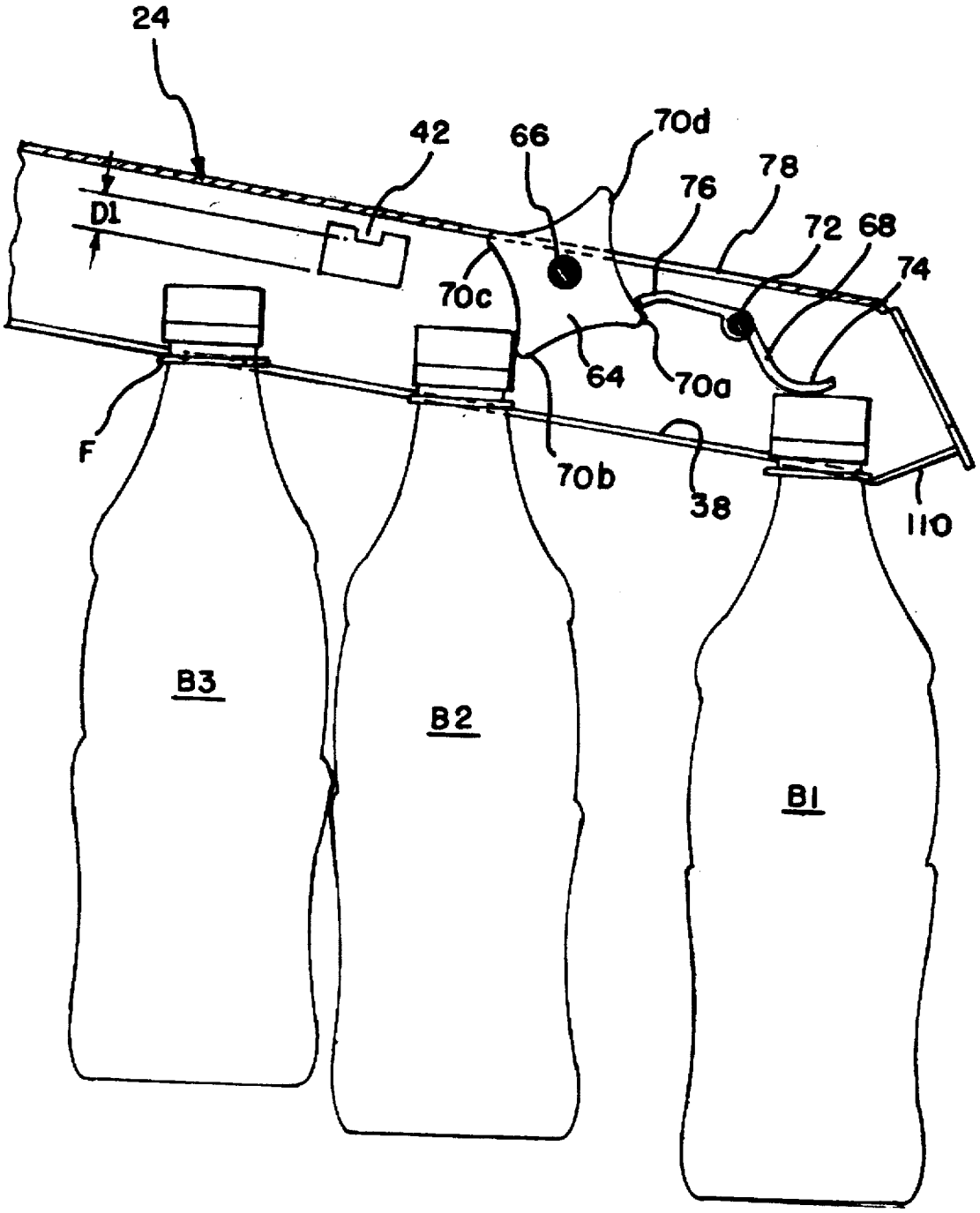
FIG. 3 is a fragmentary longitudinal sectional view of one of the tracks in FIG. 1, showing the ratchet wheel held in the blocking position.

According to the invention, the side walls 30 and 32 of the track 24 are provided at near each of the front and rear ends 120 and 122 (shown in FIG. 1) with a pair of opposed generally rectangular apertures 40 (only one shown in FIGS. 2 and 3).

The apertures 40 near the front end 120 of the track 24 are identical in size and receive the front transverse member 26 so that the front portion of the track 24 is supported by the member 26. As shown in FIG. 3, a tab 42 is projecting downwardly from the perimeter of each of the front apertures 40. This tab 42 is provided to be received in recesses or openings 44 formed in the transverse member 26 as will be described later.

The apertures 40 near the rear end 122 of the track 24 are of the same size and receive the rear transverse member 28 so that the rear portion of the track 24 is supported by the member 28. These apertures are also provided with tabs for insertion into the openings 44 in the rear transverse member 28.

The transverse member 26 may be formed of metal or plastic and preferably of metal. It is extended between and supported by the front corner posts 12 and 14. The opposite ends of the member 26 are removably mounted on the front corner posts 12 and 14 by means of suitable brackets respectively. Each bracket has a first portion for engagement with the associated end of the transverse member 26 and a second portion for insertion into one of the openings of the associated front corner post. A typical example of such a bracket includes a T-hook, a S-hook or the like. FIG. 1 shows a T-hook 50 loosely engaged with each end of the transverse members so as to be a built-in part of the dispenser unit. As best shown in FIG. 2, the transverse member 26 is of a tubular construction having a rectangular cross section. The upper wall of the transverse member 26 is formed with the openings 44. The vertical outer size "D2" of the transverse member 26 is slightly less than the distance "D1" (shown in FIG. 3) between the lower edge of each aperture 40 and the lower end of the associating tab 42. By this arrangement, the track 24 is allowed to slide along the member 26. However, by inserting the tabs 42 of the track 24 into the openings 44, the track 24 can be locked in desired positions on the transverse member 26.

The rear transverse member 28 is extended between the rear corner posts of the rack and removably mounted at its opposite ends on the rear corner posts 16 and 18. This member 28 also allows the track 24 to slide therealong. The remainder of the rear member 28 is identical to the front member 26.

It should be readily recognized that the number of the tracks on the transverse members 26 and 28 can be adjusted easily by removing the tracks of a desired number from the members 26 and 28 or by adding one or more similar tracks onto the transverse members 26 and 28.

The track 24 is provided with a stopper 106 at its front end. The stopper 106 is best shown in FIG. 2 wherein it comprises a length of the track 24 adjacent to the front end. Such a length is upturned relative to the immediately preceding length of the track 24 to provide forwardly upwardly sloping portions 108 and 110 (shown in FIGS. 2 and 3) of the rails 36 and 38. When the leading bottles in the track 24 travel along the sloping portions 108 and 110, they are braked to a stop and presented for removal from the track 24. The upturned length of the track 24 may be formed integrally with the track 24 or it may be provided as a separate replaceable portion.

As best shown in FIG. 2, a gate mechanism 62 is provided at the location near the front end between the stopper 106 and the front transverse member 26. The mechanism 62 comprises a ratchet wheel 64 rotatably supported on a horizontal shaft 66 and a catch arm 68 for controlling rotation of the wheel 64. The shaft 66 is extended between the side walls 30 and 32 of the track 24 and secured at it opposite ends to the walls 30 and 32. The wheel 64 is provided with a plurality of teeth 70*a*, 70*b*, 70*c* and 70*d* extending radially outwardly of the shaft 66. These teeth 70*a*–70*d* are disposed with angular intervals so that the upper end of a bottle can be received between adjacent teeth.

As rotated to a lowermost position, each tooth is disposed within the bottle pathway in the track 24 to block the flow of bottles along the track 24.

The catch arm 68 is pivotally supported at an intermediate portion thereof on a second horizontal shaft 72 interposed between the first shaft 66 and the front end of the track 24. The shaft 72 is generally parallel to the first shaft 66 and extended between the side walls 30 and 32 with its opposite ends secured to the side walls 30 and 32. As best shown in FIG. 3, the arm 68 is extended both forward and backward from the shaft 72. The forward end 74 of the arm 68 is disposed near the front end of the track 24 approximately above the sloping portions 108 and 110 so that it can cooperate with the leading bottles on the track 24. The forward end 74 is curved to form a downwardly convexly bowed lower surface. This curved surface minimizes the contact between the arm 68 and the bottles on the track 24, which in turn reduces the chance that the bottles are jammed under the arm 64. The backward end 76 of the arm 68 is disposed adjacent to the wheel 64 to be capable of engaging the teeth of the wheel 64. The backward end 76 is slightly downturned to allow the wheel 64 to rotate only in a single direction when the arm 68 is in the position to engage the wheel 46. An opening 78 is formed in the top wall 34 of the track 24 near the front end to allow proper operation of the wheel 64 and the arm 68.

The display unit described above is mounted on the rack by using the brackets 50. The openings 20 or 22 of the corner posts with which the brackets 50 are engaged are selected such that each of the front and rear transverse members 26 and 28 is held substantially horizontally while the rear transverse member 28 is supported at the position higher than the front transverse member 26. This arrangement permits the tracks 24 and 25 to be inclined downwardly toward their respective front ends. The angle of inclination of the tracks from the horizontal may be about 1 to 20 degrees, preferably about 2 to 18 degrees and most preferably about 8 to 10 degrees. The inclination of the tracks allows the bottles on the tracks to gravity feed to the front ends of the tracks as the leading bottles in each row successively are removed from the tracks.

The merchandising device thus assembled can be either front-loaded or back-loaded.

When loaded through the rear end of the track 24, bottles slide down on the track 24 toward the front end. The leading bottle B1 in the track 24 first reaches the front end of the track 24, is braked to a stop by the stopper 106 and pushes the forward end 74 up so that the arm 68 takes the catching position as shown in FIG. 3. When pivoted into the catching position due to the leading bottle B1, the arm 68 is engaged at its backward end 76 with one of the teeth such as at **70*a* and prevents the ratchet wheel 64 from rotating counterclockwise as viewed in FIG. 3. This causes the wheel 64 to block the bottle pathway at the location behind the leading bottle B1 so that the second leading bottle B2 is captured by the tooth 70*b* and disposed at a space from the leading bottle B1. As a result, the leading bottle B1** is kept free of pressure of the bottles behind it and thus is disposed substantially vertical.

Figure 4:
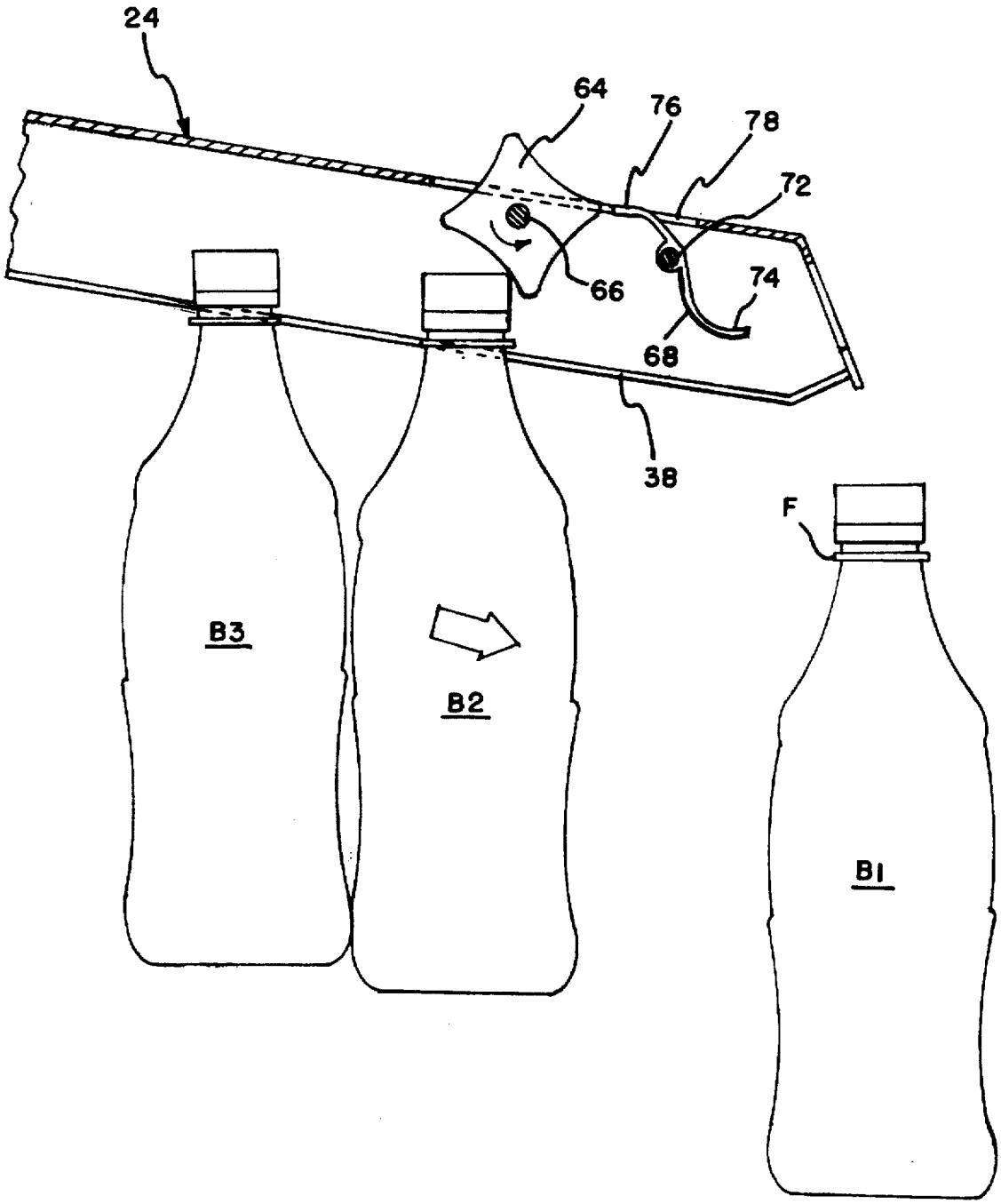
FIG. 4 is a cross-sectional view similar to FIG. 3, showing the second leading bottle which has released by the ratchet wheel and sliding down on the track.

FIG. 4 show the process in which the next leading bottle B2 replaces the leading bottle B1. When the bottle B1 is removed from the front end of the track 24, the forward end 74 of the arm 68 is allowed to pivot down to the releasing position as shown in FIG. 4 where the backward end 76 is moved into the opening 78. This releases the ratchet wheel 64 from the backward end 76 of the arm 68 and allows it to freely rotate in the direction of the arrow. As a result, the second leading bottle B2 is allowed to slide down toward the front end of the track 24. At the front end, the bottle B2 pushes the arm 68 back to the catching position so that forward movement of the third leading bottle B3 is blocked by the ratchet wheel 64.

Figure 5:
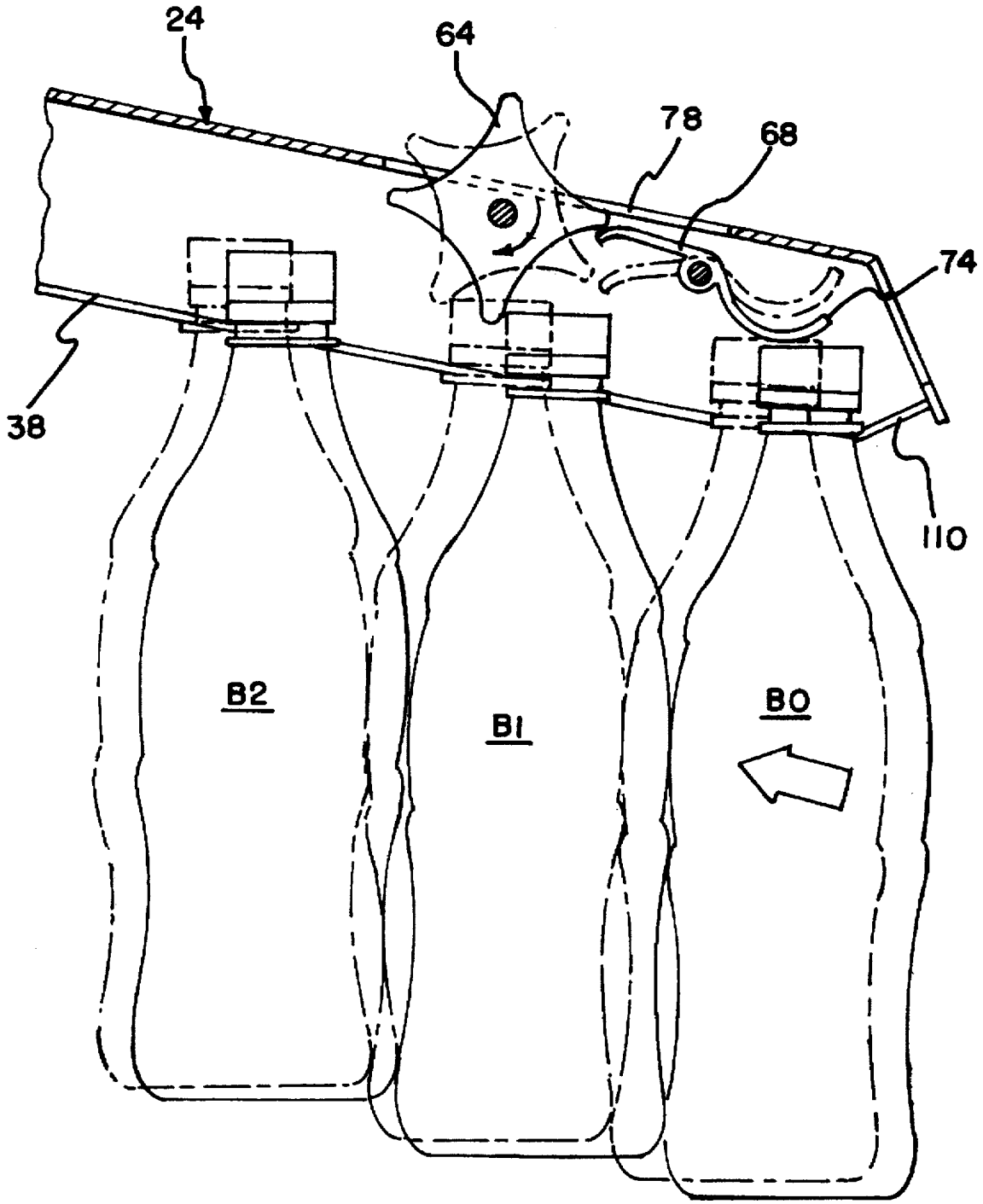
FIG. 5 is a cross-sectional view similar to FIG. 3, showing movement of the ratchet wheel and the catch arm during front loading of bottles.

Bottles may be loaded into the track through the front end according to the device of the invention. When new bottles are front loaded, the arm 68 is moved by such new bottles to the catching position. However, because the arm 68 allows the wheel 64 to freely rotate clockwise as viewed in FIG. 5, the bottles are allowed to move backward along the pathway. More particularly, when a new bottle B0 is loaded into the track 24 as shown in FIG. 5, the arm 68 takes the catching position as shown by the solid line. Loading of another new bottle through the front end will push the bottles B0–B2 backwards to the positions shown by the phantom lines, which causes clockwise rotation of the wheel 64. Meanwhile, the arm 68 reciprocates between the catching position and the position shown by the phantom line to allow clockwise rotation of the wheel 64. Such clockwise rotation of the wheel 64 is facilitated by the arrangement wherein the backward end 76 of the arm 68 is downturned and the forward end 74 can afford upward pivotal movement from the catching position.

It will be recognized that many variations may be made to the foregoing within the scope of the present invention. For example, a stopper comprising a pair of leaf springs may be used instead of the stopper 106. Each leaf spring may be secured at near its upper end to the outside surface of the respective track side wall by a rivet, and is provided at near its lower end with a protrusion. The protrusion passes through a small aperture formed in the respective side wall and projects inwardly from the inside surface of that side wall. These protrusions of the stopper are normally disposed in the bottle pathway. An example of the leaf spring stopper is described in U.S. patent application Ser. No. 08/389,379 owned by the assignee of the invention, which is hereby incorporated by reference.

What is claimed is:

1. A merchandising device for bottles each having an integrally formed annular neck flange, comprising:

a track having a front end and a rear end and defining a pathway therealong to support a row of said bottles such that said bottles are suspended by said neck flanges thereof for movement along said pathway and are removable from said pathway through said front end;

a support structure for supporting said track such that said track is inclined downwardly toward said front end whereby said bottles when supported by said track are allowed to gravity feed toward said front end as a leading bottle in said row is removed from said pathway;

a stopper provided at said front end for engagement with said leading bottle so as to prevent said leading bottle from being accidentally removed through said front end whereby said leading bottle when arriving at said front end is stopped and presented for removal from said pathway; and gate means for blocking said pathway when said leading bottle is at said front end so that forward movement of the other bottles in said row is blocked by said gate means whereby said leading bottle is maintained free of pressure of said other bottles and disposed substantially vertical, said gate means comprising a rotary rachet wheel disposed at least partially in said track for engagement with said bottles and a movable catch arm arranged to take a catching position for restricting rotation of said ratchet wheel in response to arrival of said leading bottle at said front end.

2. The merchandising device according to claim 1, wherein said ratchet wheel is disposed between said stopper and said rear end.

3. The merchandising device according to claim 1, said catch arm is arranged to take a releasing position to allow rotation of said ratchet wheel in response to removal of said leading bottle from said front end.

4. The merchandising device according to claim 3, wherein said catch arm is pivotally connected to said track for movement between said catching and releasing positions.

5. The merchandising device according to claim 4, wherein said catch arm has a forward end adjacent said front end and extends generally along said pathway to a backward end, said arm being pivotally connected at an intermediate position thereof to said track, and said ratchet wheel is located behind said catch arm so as to be engaged by said backward end when said catch arm is in said catching position.

6. The merchandising device according to claim 5, said forward end of said catch arm is disposed within said pathway when said catch arm is in said releasing position whereby when said leading bottle arrives at said front end, said forward end of said arm is thrust aside by said leading bottle so as to take said catching position.

7. The merchandising device according to claim 1, wherein said catch arm is arranged to prevent said wheel from rotating only in a single direction.

8. The merchandising device according to claim 1, wherein said ratchet wheel is connected to said track for rotation about a substantially horizontal axis generally perpendicular to said track.

9. The merchandising device according to claim 1, wherein said ratchet wheel has teeth extending radially outwardly of a rotational axis of said wheel, said teeth being spaced so that an upper end of a bottle is received between adjacent teeth.

10. The merchandising device according to claim 1, wherein said track comprises a pair of substantially parallel rails extending along said pathway, said rails being spaced apart to receive therebetween necks of said bottles such that said bottles are slidably engaged at undersides of said neck flanges with said rails, and said stopper comprises a length of said track adjacent to said front end, said length being upturned relative to an immediately preceding length of said track to provide a forwardly upwardly sloping section along which said leading bottle travels so that said leading bottle is braked to a stop and presented for removal from said pathway.

* * * * *